US008261664B2

(12) United States Patent
Von Lengeling et al.

(10) Patent No.: US 8,261,664 B2
(45) Date of Patent: Sep. 11, 2012

(54) LOADING OF EXPLOSIVES

(75) Inventors: Horst Wolfgang Friedrich Von Lengeling, Pretoria (ZA); Ewan James Sellers, Sandton (ZA); Mauritz Kotze, Kempton Park (ZA); Peter Robert Wight, Kempton Park (ZA)

(73) Assignee: AEL Mining Services Limited, Woodmead (ZA)

( * ) Notice: Subject to any disclaimer, the term of this patent is extended or adjusted under 35 U.S.C. 154(b) by 155 days.

(21) Appl. No.: 12/600,174

(22) PCT Filed: May 13, 2008 (Under 37 CFR 1.47)

(86) PCT No.: PCT/IB2008/051877
§ 371 (c)(1),
(2), (4) Date: Jul. 26, 2010

(87) PCT Pub. No.: WO2008/139413
PCT Pub. Date: Nov. 20, 2008

(65) Prior Publication Data

US 2012/0024181 A1 Feb. 2, 2012

(30) Foreign Application Priority Data

May 14, 2007 (ZA) ..... 2007/03880

(51) Int. Cl.
*F42D 1/10* (2006.01)

(52) U.S. Cl. ..... 102/313; 102/311; 102/312; 86/20.15

(58) Field of Classification Search ..... 102/313, 102/311, 312; 86/1.1, 20.15
See application file for complete search history.

(56) References Cited

U.S. PATENT DOCUMENTS

| | | | | |
|---|---|---|---|---|
| 3,125,925 | A * | 3/1964 | Ljungberg | 86/20.15 |
| 3,303,738 | A | 2/1967 | Clay et al. | |
| 3,380,333 | A | 4/1968 | Clay et al. | |
| 3,690,213 | A * | 9/1972 | Grant | 86/20.15 |
| 4,102,240 | A | 7/1978 | Cook et al. | |
| 4,195,548 | A | 4/1980 | Cook | |
| 4,369,689 | A * | 1/1983 | Donaghue et al. | 86/20.15 |
| 4,526,633 | A | 7/1985 | Lawrence et al. | |

(Continued)

FOREIGN PATENT DOCUMENTS

ES 2267365 A1 12/2004

(Continued)

OTHER PUBLICATIONS

Bradbury, Harley W., "Bulk Explosive Trucks and Current Technology, Tradestar Corporation," 1996-2001, 22 pages. Pallomari, Eduardo Berger, et al., "Intelliblast, On-Line Communication System for Explosives Auger Trucks with Satellite Support," Santiago, Chile, Apr. 20, 2004, 17 pages.

*Primary Examiner* — Michael David
(74) *Attorney, Agent, or Firm* — Daniel J. Chalker; Chalker Flores, LLP

(57) ABSTRACT

A system (10) for loading a flowable explosive into blast holes includes a mobile explosives supply unit (12) having at least one explosives feed line for feeding a flowable explosive from the supply unit (12) into a blast hole, a global positioning system (GPS) unit (14) operable to determine the position of a blast hole, and a blast hole identification processor (16) in communication with the GPS unit (14) operable to receive from the GPS unit (14) a blast hole co-ordinate position. The processor (16) is configured or programmed uniquely to identify the blast hole based on the co-ordinate position of the blast hole.

15 Claims, 4 Drawing Sheets

U.S. PATENT DOCUMENTS

| | | | | |
|---|---|---|---|---|
| 4,966,077 | A * | 10/1990 | Halliday et al. | 102/313 |
| 5,811,711 | A * | 9/1998 | Tremblay et al. | 86/20.15 |
| 2005/0103219 | A1 | 5/2005 | McClure et al. | |
| 2005/0173153 | A1 | 8/2005 | Alft et al. | |
| 2005/0263027 | A1 | 12/2005 | Johnston et al. | |

FOREIGN PATENT DOCUMENTS

| | | |
|---|---|---|
| WO | 2004/090286 | 10/2004 |
| WO | 2004/090286 A1 | 10/2004 |
| WO | 2008/074071 A1 | 6/2008 |

* cited by examiner

LOADING OF EXPLOSIVES

THIS INVENTION relates to the loading of explosives. In particular, the invention relates to a system for loading a flowable explosive into blast holes.

It is necessary to ensure that the correct amount and/or correct composition of a flowable explosive is loaded into each blast hole in an area to be blasted (often referred to as a bench). The only method of which the inventors are aware is to match the hole at which an operator is standing with a particular hole in the blast area or bench (typically indicated on a map), typically using hole identification numbers or labels. This approach can however lead to mistakes and can be time consuming.

It would thus be advantageous if a system can be provided which will reliably ensure that blast holes are correctly loaded, in a time efficient manner.

According to the invention, there is provided a system for loading a flowable explosive into blast holes, the system including a mobile explosives supply unit having at least one explosives feed line for feeding a flowable explosive from the supply unit into a blast hole;

a global positioning system (GPS) unit operable to determine the position of a blast hole; and a blast hole identification processor in communication with the GPS unit operable to receive from the GPS unit a blast hole co-ordinate position and configured or programmed, at a selected or predetermined time, uniquely to identify the blast hole based on the co-ordinate position of the blast hole.

The mobile explosives supply unit is typically in the form of a truck having a plurality of reservoirs or containers for holding a flowable explosive or flowable explosive components, such as an emulsion explosive, ammonium nitrate (grills or the like), a fuel oil (e.g. diesel), water, and a chemical gassing solution (e.g. sodium nitrite).

The mobile explosives supply unit typically also includes a plurality of explosive component feed means, such as pumps or augers, to feed flowable explosive components from their respective reservoirs for mixing to form a flowable or pumpable explosive, and a flowable explosive feed means for feeding a flowable explosive through the at least one explosives feed line into blast holes.

Typically, the GPS unit provides a coordinate position at regular intervals, e.g. one second. The blast hole identification processor may thus receive regular GPS readings from the GPS unit, or the blast hole identification processor may poll the GPS unit only at the selected or predetermined time, e.g. over a wireless network. The selected or predetermined time when the blast hole identification processor identifies the blast hole co-ordinate position must thus be such that it is known that the GPS unit is at the blast hole. This may involve, for example, the use of a manual trigger activated by an operator or the use of a specific event during the work flow of loading a blast hole, e.g. the starting of a particular pump.

The blast hole identification processor may be in communication with one or more of the explosive component feed means, and/or with the flowable explosive feed means and may be configured or programmed to control the feed means to load a predefined or calculated amount of explosive of a desired composition into at least some blast holes.

The GPS unit may be associated with, e.g. removably attached to, an outlet end portion of the explosives feed line. In this fashion, in use, the GPS unit will be close to a blast hole into which an outlet end of the explosives feed line has been inserted for loading of a flowable explosive.

Instead, the GPS unit may be configured to be worn by an operator or user of the system, and in particular by an operator handling the explosives feed line so that in use, when the operator is inserting an outlet end portion of the explosives feed line into a blast hole, the GPS unit can determine the co-ordinate position of the blast hole.

In yet a further alternative, the GPS unit may be located in or on the mobile explosives supply unit, the system including sensing means to determine the relative position of an outlet end of the explosives feed line or of an operator of the explosives feed line to the co-ordinate position of the mobile explosives supply unit, and a processor operable to calculate or determine the co-ordinate position of the outlet end or of the operator, based on the co-ordinate position of the explosives supply unit and the relative position of the outlet end or of the operator.

The system may include at least one Differential Global Positioning System station to transmit correction signals to the GPS unit.

The blast hole identification processor may be uploadable or programmable so that it can be programmed or supplied with a blast plan uniquely identifying the co-ordinate positions of blast holes, whether actually drilled or planned. The blast plan typically includes loading information for each blast hole, allowing the blast hole identification processor to control the feed means of the mobile supply unit to place a predefined or predetermined or calculated amount of explosive into particular blast holes.

Instead, or in addition, the blast hole identification processor may be configured or programmed to build up a blast plan of uniquely identified blast holes, by receiving the co-ordinate positions of the blast holes from the GPS unit.

The blast hole identification processor may be operable to receive geometry information of individual blast holes, e.g. depth and diameter, and may be configured or programmed to calculate the required amount and, if desired, composition of the flowable explosive for the individual blast holes. Thus, the system typically includes user input means, e.g. a keyboard or keypad or touch screen or the like, by means of which information can be fed to the blast hole identification processor.

The blast hole identification processor may be configured or programmed to determine the nearest programmed blast hole to a co-ordinate position received from the GPS unit when the co-ordinate position received from the GPS unit does not agree exactly with the co-ordinate position of any programmed blast hole, and to continue processing on the basis that the GPS unit is located at the co-ordinate position of said nearest programmed blast hole. The blast hole identification processor may be programmed or configured to calculate the distance between the actual co-ordinate position of the programmed blast hole and the co-ordinate position received from the GPS unit, and only to assume that the GPS unit is located at a particular programmed blast hole if said distance is less than, or equal to, a predetermined maximum distance.

It is to be appreciated that the blast hole identification processor is a conceptual module and that it may include one or more physical units each with a processor, with at least some of the one or more physical units being in communication with one another, and with different physical units or processors possibly being programmed or configured to perform different tasks.

The blast hole identification processor, or one or more of its physical units, may be mounted on or in the mobile explosives supply unit. Instead, the blast hole identification processor, or one or more of its physical units, may be a portable or handheld device. Communication between the blast hole identification processor and other components of the system and/or between physical units of the blast hole identification processor, may be wireless, or through wires if necessary or desirable.

The blast hole identification processor may be configured or programmed to keep a record or log of blast hole loading operations, e.g. the amount, type, and composition of explosives, explosive product parameters, or the like. The system thus typically includes a memory module in communication with the blast hole identification processor.

The blast hole identification processor may be operable to receive a manual input from an operator identifying a particular blast hole, i.e. the blast hole is not identified via the GPS unit but manually. The blast hole identification processor may be operable to receive explosive loading instructions for a particular blast hole as a manual input, and may be configured or programmed to execute said explosive loading instructions, e.g. by operating the explosive component feed means and/or the flowable explosive feed means.

The blast hole identification processor may be operable to receive information on blast holes that have been planned but not drilled, and may be configured or programmed to mark or identify such undrilled blast holes on a blast plan.

The system may include a zone controller in a communications network to receive information from and to provide information to said mobile explosives supply unit and to other associated mobile explosives supply units in a common blast zone of a blasting area or bench.

The zone controller may be operable to communicate with a base server to transfer blasting log files received from mobile explosives supply units to the base server and to receive blast plans for the mobile explosives supply units from the base server.

The system may include a blast viewer providing graphical information on blasting activity. The blast viewer may be in communication with a plurality of zone controllers, each zone controller providing information on blasting activity in a zone of a blasting area or bench. Typically, the blast viewer is provided by the base server.

The invention extends to a system for loading a flowable explosive into blast holes, from a plurality of mobile explosives supply units, the system including a plurality of systems as hereinbefore described, at least one zone controller operable to communicate with the blast hole identification processor associated with at least some mobile explosives supply units and a base server operable to communicate with the zone controller.

The system may include a plurality of zone controllers, each zone controller being operable to communicate with the blast hole identification processors of a plurality of mobile explosives supply units associates with said zone controller. The base server may be operable to communicate with said plurality of zone controllers.

The invention will now be described, by way of example only, with reference to the accompanying diagrammatic drawings in which FIG. 1 shows a schematic overview of components of a system in accordance with the invention for loading a flowable explosive into blast holes;

Figure 1:
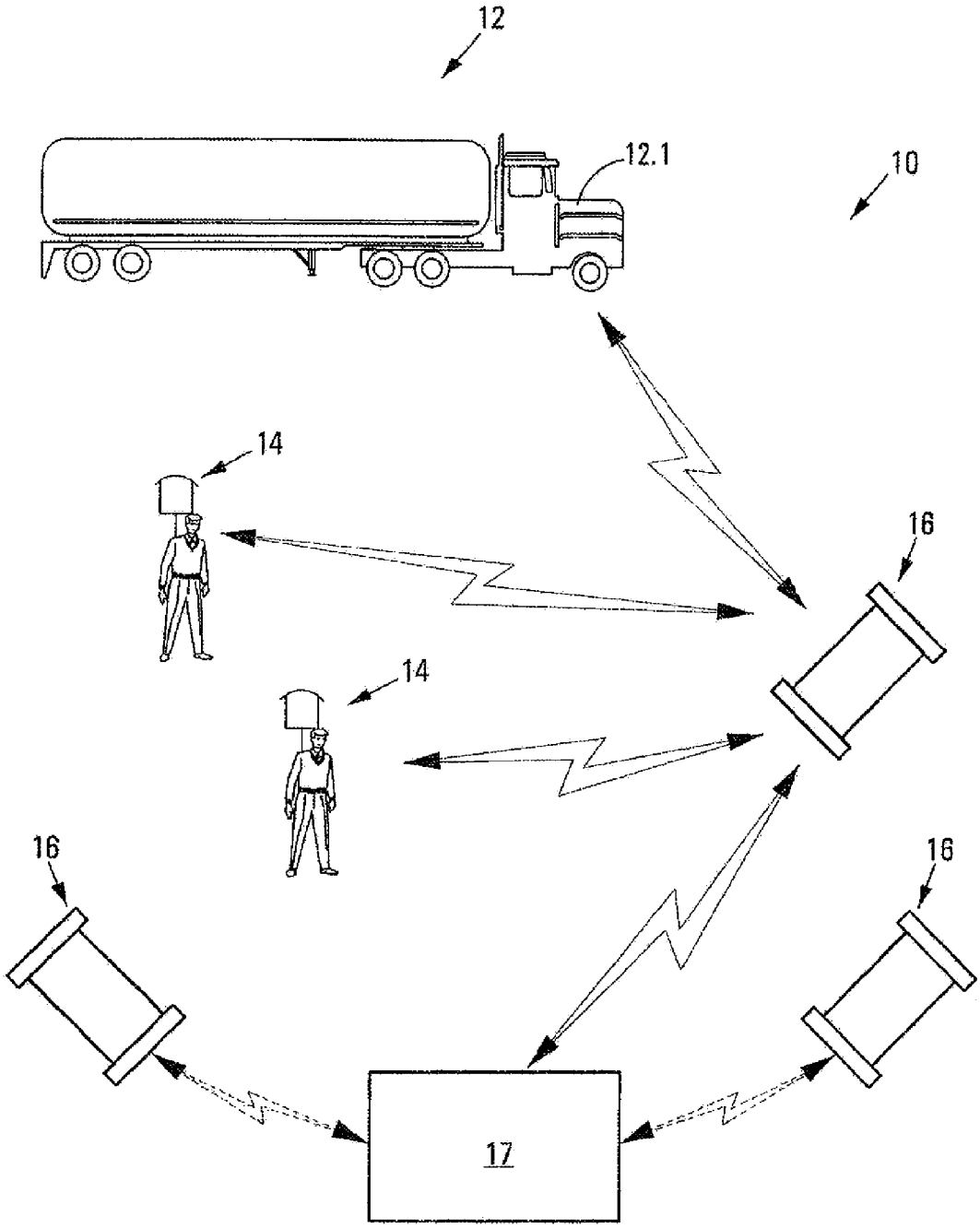

Referring to FIG. 1 of the drawings, reference numeral 10 generally indicates a system in accordance with the invention for loading a flowable explosive into blast holes. The system 10 includes, broadly, a mobile explosives supply unit 12, two Global Positioning System units or GPS units 14 carried by two operators of the system 10, a processing and communications unit 16 which is in communication with the GPS units 14 in use to receive from the GPS units 14 blast hole co-ordinate positions and configured uniquely to identify the blast holes based on the co-ordinate positions of the blast holes, and a programmable zone controller 17 in communication with the processing and communications unit 16.

FIG. 1 also shows the direction of the flow of data within the system 10. Thus, as indicated, data flows from the GPS units 14 to the processing and communications unit 16. Data also flows between the processing and communication units 16 and a programmable logic controller or PLC or any other suitable computer or embedded device (not shown in FIG. 1) forming part of the mobile explosives supply unit 12 and acting to control components (e.g. pumps) of the mobile explosives supply unit 12. The processing and communications unit 16 can thus instruct the PLC and can also receive information from the PLC, for example for recording purposes. The processing and communications unit 16 is in communication with the zone controller 17, typically using a conventional wireless communications network and protocol, and the zone controller 17 may also be in communication with further units 16 of further systems, the same as or similar to the system 10.

Figure 2:
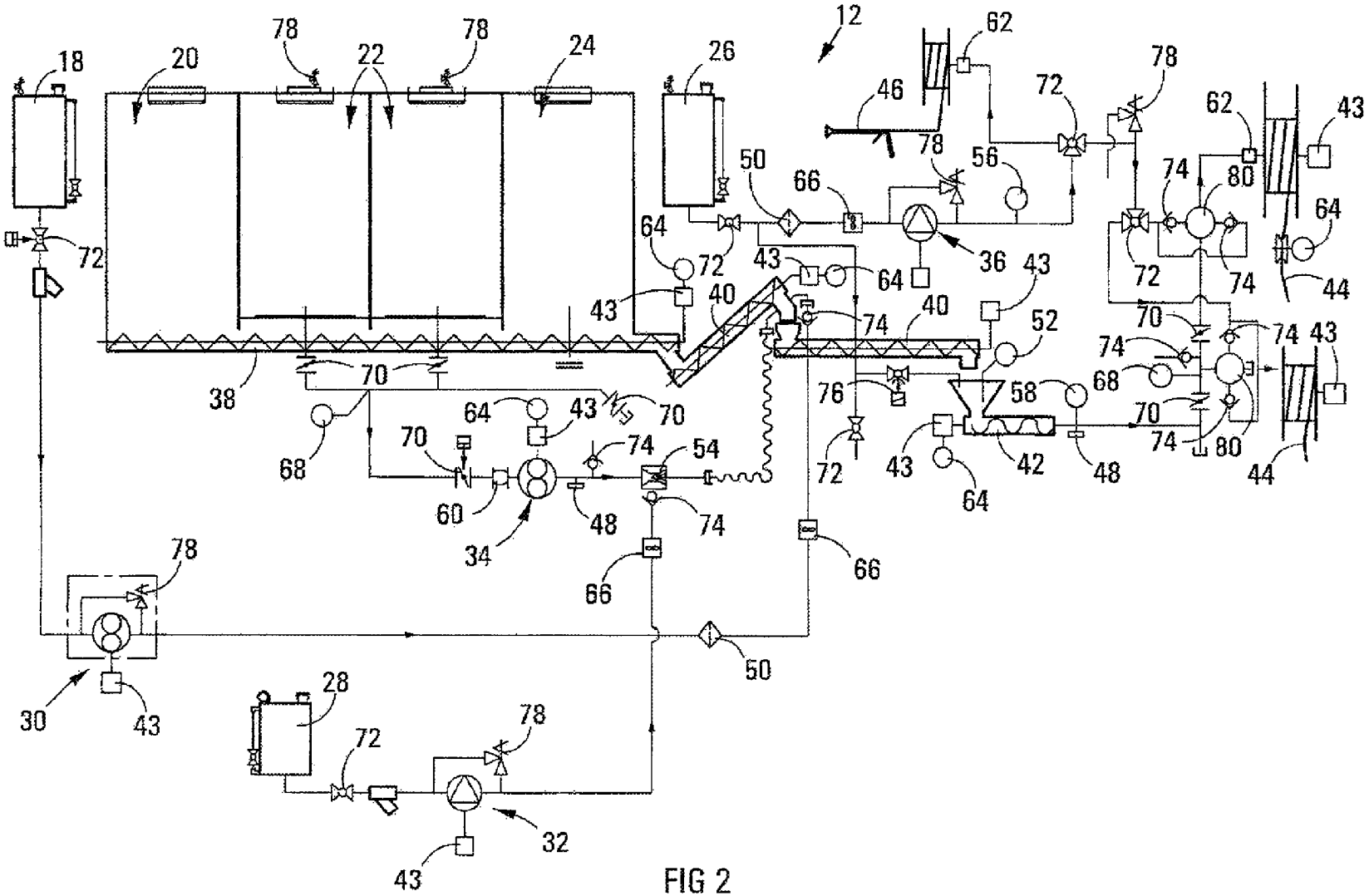
FIG. 2 shows a general process diagram of a mobile explosives supply unit forming part of the system of FIG. 1.

The mobile explosives supply unit 12 is in the form of a tanker vehicle 12.1. With reference to FIG. 2, the mobile explosives supply unit 12 comprises a diesel container 18 (typically with a capacity of about 920 l), an ammonium nitrate prill container 20, two containers 22 which can function as either emulsion explosives containers (4.5 tonnes each) or ammonium nitrate prill containers (2.5 tonnes each) and a further container 24 with the same capacity as the containers 22 and which can also hold either an emulsion explosive or ammonium nitrate prills. The unit 12 also has a water container 26 with a capacity of about 840 l. A sodium nitrite gassing solution tank 28 with a capacity of 300 l is also provided on the tanker vehicle 12.1.

Flowable explosive component feed means are provided on the tanker vehicle 12.1 in the form of a diesel gear pump 30, a gassing solution piston pump 32, an ammonium nitrate emulsion gear pump 34, a water piston pump 36, an ammonium nitrate prill auger 38 and two transfer augers 40 and an emulsion explosive progressive cavity pump 42. All of the pumps and augers are driven by hydraulic motors 43 and at least some of the augers and pumps are provided with speed sensors 64.

The emulsion explosive progressive cavity pump 42 in use feeds emulsion explosive to two motorised hoses 44 (a 2 inch and a 1¼ inch hose) and also a smaller ⅜" hose with a spray gun 46. By means of the water piston pump 36, water can also be pumped through the hoses 44 and the spray gun 46.

The mobile explosives supply unit 12 includes further components such as bursting discs 48, filters 50, a level sensor 52, an injector nozzle 54, pressure gauges 56, pressure transducers 58, rubber bellows 60, rotary joints 62, turbine meters 66, temperature sensors 68, butterfly valves 70, ball valves 72, check valves 74, diaphragm valves 76, pressure relief valves 78 and water injectors 80.

The mobile explosives supply unit 12 is capable of transporting ammonium nitrate emulsion, or components for forming an ammonium nitrate emulsion explosive, to a blast site, and to prepare a sensitised emulsion explosive on site and pump the explosive into blast holes using the hoses 44. The sensitised ammonium nitrate emulsion explosive can be made up according to any desired recipe. However, the general operation of a mobile explosives supply unit such as the mobile explosives supply unit 12 is well known to those skilled in the art and will not be further described.

Figure 3:
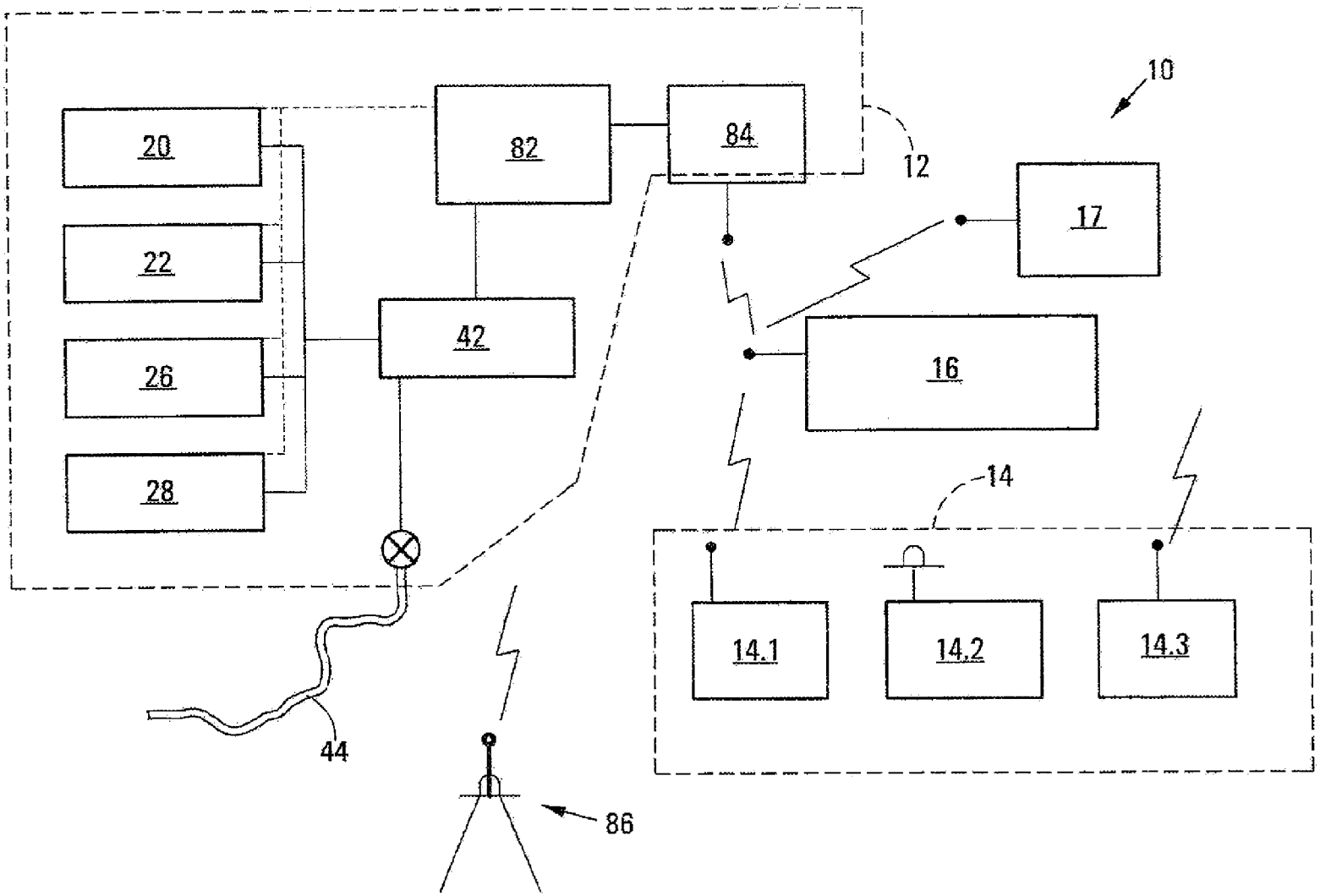
FIG. 3 shows a functional block diagram of main components of the system of FIG. 1.

Turning now to FIG. 3, the components of the system 10 and their relationship to one another will now be further described.

The mobile explosives supply unit 12 also includes a programmable logic controller or PLC 82 with a wireless communications module 84. By means of the wireless communications module 84, the PLC 82 can communicate with the processing and communications unit 16. If desired or necessary, a wired communications arrangement may be used.

The PLC 82 controls the feeding of ammonium nitrate, ammonium nitrate emulsion, water and gassing solution via the explosive component feed means shown in FIG. 2. The PLC 82 also controls the emulsion explosive progressive cavity pump 42 feeding sensitised ammonium nitrate emulsion explosive to the hoses 44. As will thus be appreciated, by means of the PLC 82, the composition of the sensitised ammonium nitrate emulsion explosive can be controlled, as well as the feed rate and amount of sensitised ammonium nitrate emulsion explosive going into a particular blast hole.

The processing and communications unit 16 in the embodiment of the invention illustrated is a hand-held unit with a display screen, input keys and wireless communications capability.

Each GPS unit 14 comprises a wireless communications module 14.1, a GPS receiver 14.2 and a zero watt radio differential correction module 14.3. By means of the wireless communications module 14.1 each GPS unit 14 can communicate with the processing and communications unit 16. As will be appreciated, if desired or necessary, a wired communications arrangement between the units 14 and 16 may be used.

The system 10 further includes a Differential Global Positioning System station 86 for broadcasting GPS correction information to the zero watt radio differential correction module 14.3.

Instead of using the zero watt radio differential correction module 14.3, a differential GPS correction signal may be delivered using wireless internet, also known as WIFI. As will be appreciated, it is in principle possible to transmit the differential GPS correction signals and any other signals between components of the system 10 using any type of radio provided that the radio signals do not interfere with any detonator systems being used, in practice meaning that specific frequencies and transmission power levels are to be employed.

The system 10 also allows uncorrected GPS recordings of blast hole positions to be processed at a later stage, e.g. a day after the GPS measurements were taken. Files with correction information, provided by one or more national survey departments, can typically be downloaded from the internet and used to correct the raw GPS measurements. As will be appreciated, in this case there is a time lag between the capturing of the GPS measurements and the correction of the GPS data. When such post-processing is being used to correct GPS data, the system 10 should not be used instantly to identify a blast hole and to load explosives into the blast hole, as the raw uncorrected GPS data may lead to errors in the identification of the blast holes. The post-processed, corrected GPS data may however be used to prepare a blast plan for subsequent loading of explosives into the blast holes.

The zone controller 17 strictly speaking does not form part of the system 10 only, as it is typically shared between a number of systems 10 active in a blasting zone. The zone controller 17 is thus in communication with the processing and communications unit 16 of the system 10, but also with the processing and communications units of other identical or similar systems for loading a flowable explosive into blast holes. Typically, all of the systems communicating with the zone controller 17 are active in a common zone or blast area of a mine or the like.

Figure 4:
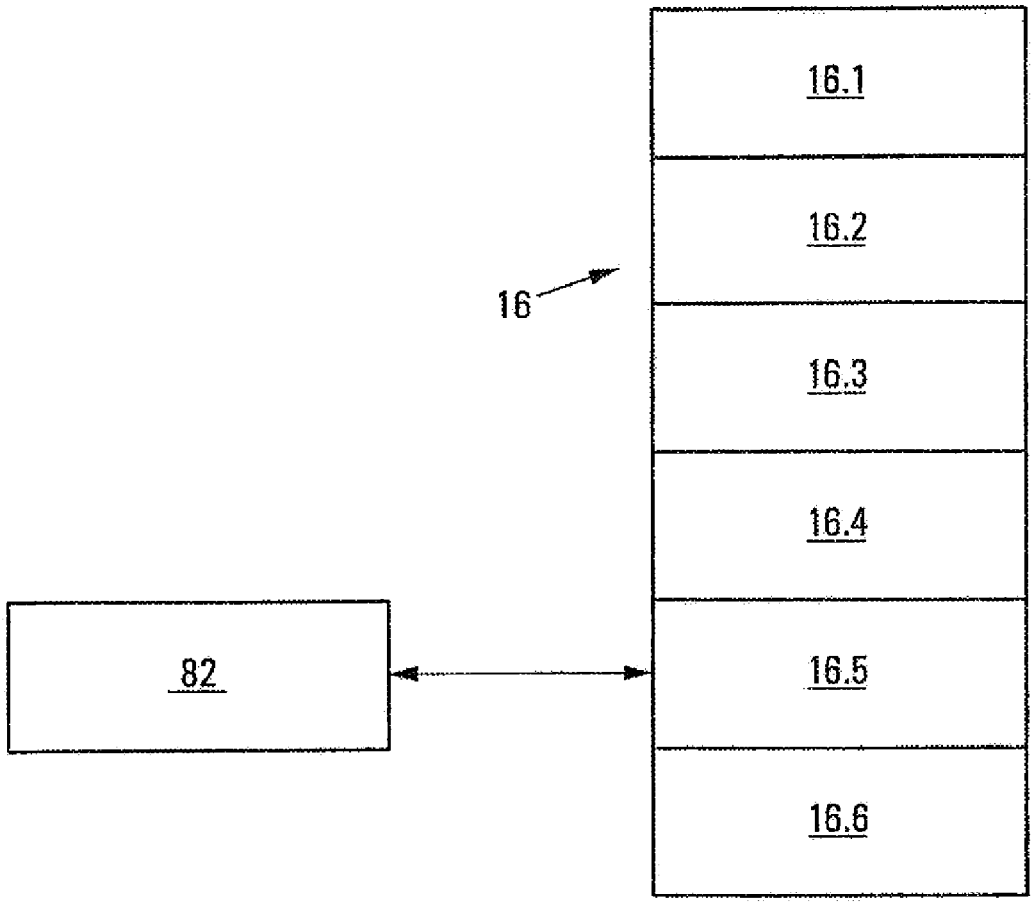
FIG. 4 shows a functional block diagram of processing modules or units of the system of FIG. 1.

As shown in FIG. 4 of the drawings, the PLC 82 is in communication with the processing and communications unit 16. Uploading and downloading of information into and from the system 10, and most of the processing, is done in the processing and communications unit 16. The unit 16 comprises a blast viewer module 16.1, a hole location module 16.2, a blast plan builder module 16.3, a memory module 16.4, a communications module 16.5 and a loading controller module 16.6.

As previously indicated, the processing and communications unit 16 is a hand-held unit, thus providing flexibility for an explosives engineer to visit a particular blast hole if needed, without leaving the presence of the processing and communications unit 16. However, if desired, all of the functions of the processing and communications unit 16 can be incorporated into the PLC 82 or any other suitable onboard computing device on the mobile explosives supply unit 12.

In one application of the system 10 of the invention, the processing and communications unit 16 receives a daily blast plan for a specific zone of a mine or the like, typically from its associated zone controller 17. The daily blast plan includes the co-ordinate positions of drilled blast holes and can be uploaded to the processing and communications unit 16 using any suitable data transfer protocol or means. The daily blast plan is then stored in the memory module 16.4 of the processing and communications unit 16.

The loading controller module 16.6 is the main processing module of the system 10 and controls the actual loading of blast holes, via the PLC 82. The loading controller module 16.6 can select a particular mobile explosives supply unit for execution of a particular uploaded blast plan and provides updated information to the blast viewer module 16.1, which gives real time viewing of the pumping and loading process. The loading controller module 16.6 communicates with the PLC 82 to transfer blast hole information to the PLC 82. The loading controller module 16.6 also processes loading information received back from the PLC 82 and can change instructions to the PLC 82 based on information received back from the PLC 82, eg that a particular blast hole is not known to the PLC 82.

Loading information received back from the PLC 82 is passed by the loading controller module 16.6 to the memory module 16.4 for storing or logging of the data.

The hole location module 16.2 processes the daily blast plan and uses the GPS co-ordinates for each blast hole to build up a virtual plan. The GPS latitude and longitude co-ordinates are converted to an applicable mine co-ordinates grid, if necessary or desirable. The hole location module 16.2 also uses a radius value that is stored in the processing and communications unit 16, to create a reference area around each planned blast hole position. When the co-ordinate position of an operator handling the nozzle of a hose 44 is received from the GPS unit 14 carried by said operator, or if the GPS co-ordinate position of a nozzle is received from a GPS unit 14 attached to the nozzle, and said GPS co-ordinate position is within the reference area of a particular blast hole, then the hole location module 16.2 assumes that the nozzle of the hose 44 is in the blast hole falling within that reference area. The hole number for that blast hole is then selected and passed to the loading controller module 16.6.

The blast plan builder module 16.3 allows an operator to pre-build a blast plan when an electronic blast plan file is not available from a survey department. Using a GPS unit 14, the operator can establish the GPS co-ordinate position of each blast hole and give that information to the blast plan builder module 16.3 (e.g. in the form of mine co-ordinates). If desired, the hole depth and diameter for each blast hole can also be provided to the blast plan builder module 16.3. The blast plan builder module 16.3 includes a formula mass calculator which uses the information on the blast hole positions and dimensions to calculate the amount and composition of ammonium nitrate emulsion explosive to be used in each blast hole, taking any specified constraints into consideration.

The blast viewer module 16.1 provides a graphical representation of the entire blast area or bench in which the system 10 is being used, allowing for easy navigation, control and access to information.

By means of the processing and communications unit 16, the system 10 can load a blast plan, allow the user to navigate around the blast plan, and snap to a particular blast hole. Recording of any emulsion explosives charging activity happens automatically. When loading blast holes according to the blast plan, the hole location module 16.2 takes a GPS reading automatically and snaps to the hole position. The operator is required manually to transmit the required amount of explosive to the PLC 82. Although the PLC 82 can automatically calculate the amount and pump accordingly, it is considered desirable that the system 10 does not override the operator. The operator can thus still pump more or less explosive if desired.

The system 10 can pump into holes that are not identified on an existing blast plan, top up existing holes and can identify holes that have been planned, but have not been drilled. The system 10 can also be used in a manual mode where an operator identifies a blast hole based on its relative position in the blast area and then manually controls the charging of that blast hole. Advantageously, if explosives charging specifications are not provided up-front in a blast plan, the charging specification can be calculated by the system 10 as a function of the geometry of a blast hole.

The zone controller 17 is used to link the mobile supply units 12 of a plurality of systems 10 operating in a common zone of a blast area or bench and to co-ordinate a blast plan for said common zone. The zone controller 17 can communicate with a base server, e.g. to upload blasting log files to the base server and to download a blast plan, or a plurality of blast plans, for a zone of the bench. Typically, the uploaded blasting log files are processed by the base server to compare actual explosives usage and other logged data with the information provided in the blast plan or blast plans, and produces reports, which can be fed to a SAP system.

The base server also synchronizes data from a plurality of zone controllers 17 to provide an overview of blasting activity for the entire blasting area or bench. The most recent information available from the zone controllers 17 is used for this purpose. The information may be downloaded in real time if a zone controller 17 is in wireless communication with the base server, or may be downloaded only when the zone controller 17 is returned to the base server for uploading.

Typically, the base server provides a graphical overview of the bench and the system 10 allows for making notes regarding blast holes, or attaching selected information to blast holes, or about missing holes, with the information being available on the base server's graphical overview of the bench.

Using the system 10, blast hole positions can be identified uniquely and quickly to eliminate errors. By means of the use of Differential Global Positioning System stations and a snap-to radius around each blast hole, difficulties caused by small inaccuracies in measured GPS co-ordinate positions can be minimized.

The invention claimed is:

1. A system for loading a flowable explosive into blast holes, the system including a mobile explosives supply unit having at least one explosives feed line for feeding a flowable explosive from the supply unit into a blast hole and a plurality of reservoirs or containers for holding a flowable explosive or flowable explosive components, the mobile explosives supply unit also including a plurality of explosive component feed means to feed flowable explosive components from their respective reservoirs for mixing to form a flowable or pumpable explosive, and a flowable explosive feed means for feeding a flowable explosive through the at least one explosives feed line into blast holes;

a global positioning system (GPS) unit operable to determine the position of a blast hole; and a blast hole identification processor in communication with the GPS unit operable to receive from the GPS unit a blast hole co-ordinate position and configured or programmed uniquely to identify the blast hole based on the co-ordinate position of the blast hole, the blast hole identification processor being in communication with one or more of the explosive component feed means, and/or with the flowable explosive feed means and being configured or programmed to control the feed means to load a predefined or calculated amount of explosive of a desired composition into at least some blast holes.

2. The system as claimed in claim 1, in which the GPS unit is associated with or mounted to an outlet end portion of the explosives feed line.

3. The system as claimed in claim 1, in which the GPS unit is configured or adapted to be worn by an operator or user of the system handling the explosives feed line so that in use, when the operator is inserting an outlet end portion of the explosives feed line into a blast hole, the GPS unit can determine the co-ordinate position of the blast hole.

4. The system as claimed in claim 1, in which the GPS unit is located in or on the mobile explosives supply unit, the system including sensing means to determine the relative position of an outlet end of the explosives feed line or of an operator of the explosives feed line to the co-ordinate position of the mobile explosives supply unit, and a processor operable to calculate or determine the co-ordinate position of the outlet end or of the operator, based on the co-ordinate position of the explosives supply unit and the relative position of the outlet end or of the operator.

5. The system as claimed in claim 1, in which the blast hole identification processor is uploadable or programmable so that it can be programmed or supplied with a blast plan uniquely identifying the co-ordinate positions of blast holes, whether actually drilled or planned.

6. The system as claimed in claim 1, in which the blast hole identification processor is configured or programmed to build up a blast plan of uniquely identified blast holes, by receiving the co-ordinate positions of the blast holes from the GPS unit.

7. The system as claimed in claim 1, in which the blast hole identification processor is operable to receive geometry information of individual blast holes, and is configured or programmed to calculate the required amount and, if desired, composition of the flowable explosive for the individual blast holes.

8. The system as claimed in claim 1, in which the blast hole identification processor is configured or programmed to determine the nearest programmed blast hole to a co-ordinate position received from the GPS unit when the co-ordinate position received from the GPS unit does not agree exactly with the co-ordinate position of any programmed blast hole, and to continue processing on the basis that the GPS unit is located at the co-ordinate position of said nearest programmed blast hole.

9. The system as claimed in claim 1, which includes a memory module in communication with the processor, and in which the blast hole identification processor is configured or programmed to keep a record or log of blast hole loading operations.

10. The system as claimed claim 1, in which the blast hole identification processor is operable to receive a manual input from an operator identifying a particular blast hole, i.e. the blast hole is not identified via the GPS unit but manually, and in which the blast hole identification processor is operable to receive explosive loading instructions for a particular blast hole as a manual input, and is configured or programmed to execute said explosive loading instructions.

11. The system as claimed in claim 1, in which the blast hole identification processor is operable to receive information on blast holes that have been planned but not drilled, and is configured or programmed to mark or identify such undrilled blast holes on a blast plan.

12. The system as claimed in claim 1, which includes a zone controller in a communications network to receive information from and to provide information to said mobile explosives supply unit and to other associated mobile explosives supply units in a common blast zone of a blasting area or bench.

13. The system as claimed in claim 12, in which the zone controller is operable to communicate with a base server to transfer blasting log files received from mobile explosives supply units to the base server and to receive blast plans for the mobile explosives supply units from the base server.

14. The system as claimed in claim 12, which includes a blast viewer providing graphical information on blasting activity and in which the blast viewer is in communication with a plurality of zone controllers, each zone controller providing information on blasting activity in a zone of a blasting area or bench.

15. The system as claimed in claim 1, which includes a blast viewer providing graphical information on blasting activity.

* * * * *